US005361520A

United States Patent [19]

Robinson

[11] Patent Number: 5,361,520

[45] Date of Patent: Nov. 8, 1994

[54] LOCKING PIN APPARATUS

[75] Inventor: Howard W. Robinson, Grapevine, Tex.

[73] Assignee: GH Hensley Industries, Inc., Dallas, Tex.

[21] Appl. No.: 97,109

[22] Filed: Jul. 26, 1993

Related U.S. Application Data

[63] Continuation-in-part of Ser. No. 807,714, Dec. 16, 1991, Pat. No. 5,233,770.

[51] Int. Cl.[5] ..... E02F 9/28

[52] U.S. Cl. ..... 37/458; 37/455

[58] Field of Search ..... 37/455–458; 172/750

[56] References Cited

U.S. PATENT DOCUMENTS

| | | | |
|---|---|---|---|
| 564,664 | 7/1896 | Trim et al. . | |
| 2,039,058 | 4/1936 | Cooke | 403/374 |
| 2,901,845 | 9/1959 | Whisler . | |
| 3,022,586 | 2/1962 | Towne . | |
| 3,121,289 | 2/1962 | Eyolfson . | |
| 3,440,745 | 5/1966 | Palm . | |
| 3,520,076 | 7/1967 | Nichols . | |
| 3,520,224 | 7/1970 | Hensley et al. | 37/457 |
| 3,526,435 | 9/1970 | Krekeler | 37/457 |
| 3,572,785 | 3/1971 | Larson | 37/457 |
| 3,832,077 | 8/1974 | Von Mehren . | |
| 4,069,731 | 1/1978 | Stang . | |
| 4,187,035 | 2/1980 | Colburn . | |
| 4,231,173 | 11/1980 | Davis . | |
| 4,296,530 | 10/1981 | Muller et al. . | |
| 4,335,532 | 6/1982 | Hahn et al. . | |
| 4,404,760 | 9/1983 | Hahn et al. . | |
| 4,501,079 | 2/1985 | Hahn et al. . | |
| 4,516,340 | 5/1985 | Launder | 37/457 |
| 4,577,423 | 3/1986 | Hahn . | |
| 4,602,445 | 7/1986 | Nilsson . | |
| 4,716,667 | 1/1988 | Martin . | |
| 4,761,900 | 8/1988 | Emrich . | |
| 4,823,487 | 4/1989 | Robinson | 37/457 |
| 5,074,062 | 12/1991 | Hahn et al. . | |
| 5,152,088 | 10/1992 | Hahn | 37/458 |
| 5,233,770 | 8/1993 | Robinson | 37/456 |

FOREIGN PATENT DOCUMENTS

| | | | |
|---|---|---|---|
| 16640 | 12/1971 | Canada | 37/456 |

*Primary Examiner*—Randolph A. Reese
*Assistant Examiner*—Spencer Warnick
*Attorney, Agent, or Firm*—Harris, Tucker & Hardin

[57] ABSTRACT

A locking pin (100) for use captively retaining a tooth (14) on an adapter portion (12) of an excavating tooth and adapter assembly has a primary wedge member (110) with an integral spring (120) extending upward from the member's distal end (116). A first positive stop means (130) extends from the wedge member (110) while an opposing second positive stop means (122) extends from the integral spring (12). After insertion, the locking pin (100) prevents separation of tooth (14) from adapter portion (12) while the first and second positive stop means (130, 122) prevent accidental loss of the locking pin (100) from the assembly. To remove the locking pin, a force sufficient to separate the first positive stop means (130) from the pin (100) is exerted to drive the pin (100) from the assembly. In another embodiment, the integral spring extends from a lateral surface of the locking pin (700, 800). In another embodiment, the locking pin (900) comprises stop means (910, 912) which are radially extendable by spring means (908).

16 Claims, 9 Drawing Sheets

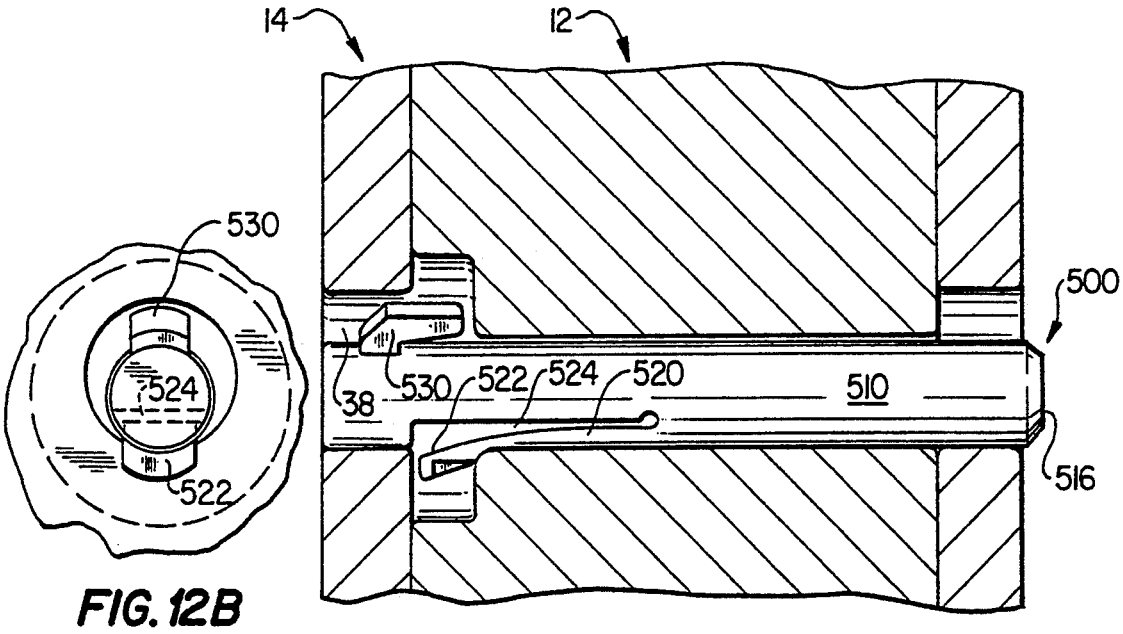
FIG. 12B
FIG. 12A
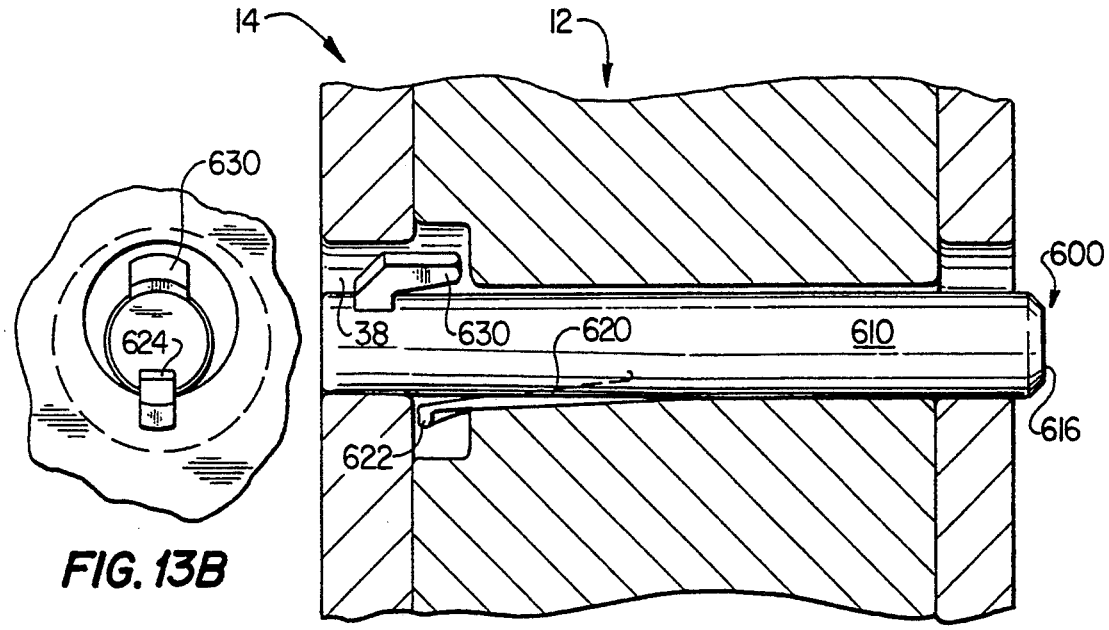
FIG. 13B
FIG. 13A

LOCKING PIN APPARATUS

The present application is a continuation-in-part of co-pending U.S. patent application Ser. No. 07/807,714 filed on Dec. 16, 1991 and patented as U.S. Pat. No. 5,233,770 on Dec. 10, 1993 and also entitled "Locking Pin Apparatus."

TECHNICAL FIELD OF THE INVENTION

The present invention relates generally to earth excavating equipment, and more particularly provides an improved locking pin apparatus that is used to captively retain a replaceable excavating tooth point on the nose portion of an adapter which, in turn, is secured to the forward lip of an excavating bucket or the like.

BACKGROUND OF THE INVENTION

Excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a device commonly referred to as a flex pin or locking pin is driven into these openings.

While locking pins have a variety of configurations, a widely used version, as representatively illustrated in U.S. Pat. No. 3,526,049 to Nichols and U.S. Pat. No. 3,685,178 to Ratkowski, typically comprises elongated, straight metal locking and wedge members which are laterally spaced apart and intersecured by an elongated central elastomeric element. As the locking pin is being driven into the aligned point and adapter nose openings, the elastomeric element is compressed and, when the pin is driven to its installed position, laterally urges a detent portion formed on one of the two metal portions of the point into engagement with a suitably configured portion of the adapter nose to captively retain the flex pin within the point and adapter openings. With the flex pin in its operative position within such openings, the elastomeric element is in a state of partial compression, rear surfaces of the tooth point openings bear against opposite end portions of the locking member, and a forward surface of the adapter nose opening bears against a longitudinally central portion of the wedge member. Forwardly directed tooth point removal forces encountered during the excavating process cause the tooth point to be driven forwardly relative to the adapter to thereby move the locking member closer to the elastomeric element, the opposite ends of the locking member preventing forward removal of the tooth point.

Two primary problems and disadvantages are present in this type of conventional flex pin construction—each of which is related to failure of the central elastomeric element. First, as the flex pin is being driven into the aligned tooth point and adapter nose openings the locking and wedge members tend to be moved longitudinally relative to one another. Thus, if the driving-in process is not carefully performed, this relative longitudinal movement can easily shear the elastomeric element, thereby mining the flex pin. Secondly, excessive forwardly directed tooth point removal loads can laterally move the locking member close enough to the wedge member to overcompress and thereby split the elastomeric element.

Various attempts have previously been made to better protect the critical central elastomeric portion of the flex pin by altering the essentially straight configuration of the locking and wedge member portions utilized in flex pin structures such as those depicted in the Nichols and Ratkowski patents. One such proposed solution, as exemplified in U.S. Pat. No. 4,192,089 to Schwappach and U.S. Pat. No. 4,446,638 to Novotny et al., is to form a central lateral recess in a front side portion of the locking member and to shorten the wedge member so that it is laterally movable into such recess against the resilient force of the central elastomeric element. With the elastomeric element in an uncompressed condition the opposite ends of the wedge member underlie the opposite end surfaces of the recess so that as the flex pin is being driven into the point and adapter openings one of the wedge member ends is driven into engagement with its adjacent recess end surface. This limits the relative longitudinal travel between the locking and wedge members to thereby limit the shear stress imposed upon the elastomeric element.

In an attempt to similarly limit the lateral compressive stress imposed on the elastomeric element, the maximum distance which the wedge member may be laterally moved into the locking member recess is limited to a distance less than the front-to-rear thickness of the elastomeric element by causing opposite end portions of the wedge member to rigidly engage portions of the locking member during travel of the wedge member into the locking member recess. In the Schwappach patent this inward travel limitation is achieved by forming on the opposite wedge member ends rearwardly directed projections which are engageable with the rear side surface of the locking recess. In the Novotny et al patent a similar result is achieved by forming forwardly facing shoulders posited adjacent opposite ends of the recess which are adapted to rigidly engage opposite end portions of the wedge member during its lateral travel into the recess. Somewhat similar schemes for protecting elastomeric flex pin portions are evidenced in U.S. Pat. No. 2,927,387 to Drover and U.S. Pat. No. 3,126,654 to Eyolfson et at.

While this conventional method of limiting lateral compression of the elastomeric element represents an improvement over somewhat simpler flex pin structures such as those depicted in the Nichols and Ratkowski patents, it creates significant structural problems in the wedge member. Specifically, when the wedge member is moved to its "stopped" position within the locking member recess a large rigid bending load is imposed thereon by the forward surface of the adapter nose opening which bears against a central rear side portion of the wedge member. To adequately strengthen the wedge member against such bending load it is necessary to appropriately increase its front-to-rear thickness. This thickening, in turn, typically requires that undesirable design modifications be made to one or all of the elastomeric elements, the locking member and the adapter nose opening.

Specifically, it is well known that the overall strength of an adapter nose is, generally speaking, inversely proportional to the size of the flex pin opening formed therethrough. Thus, if it is desired to maintain a given front-to-rear length of the adapter nose opening, the necessary thickening of the wedge member requires that the front-to-rear thickness of one or both of the elastomeric element and the locking member be correspondingly reduced. Reducing the thickness of the locking member, of course, structurally weakens the flex pin, while reducing the thickness of the elastomeric element reduces the resiliency of the flex pin and the potential lateral travel between its rigid elements. Of course, neither of these results is desirable.

If, on the other hand, the front-to-rear thickness of the elastomeric element and the locking member are maintained, the thickening of the wedge member requires that the front-to-rear length of the adapter nose opening be correspondingly increased. This, of course, undesirably weakens the adapter nose.

Therefore, a need exists for a locking pin which eliminates the use of an elastomeric element altogether. Such a locking pin would not experience the problems of dimensional limitations due to the thickness of the elastomeric element. Nor would it be limited to environments safe for elastomeric materials. A need exists for a one-piece locking pin, thereby eliminating the need to store various elements at the job site. A one-piece design would also limit the risk of error in installing the locking pin.

SUMMARY OF THE INVENTION

A locking pin assembly is provided which overcomes many of the disadvantages found in the prior art. Namely, the preferred embodiment of the present locking pin does not involve multiple elements, instead its one-piece design allows for easier storage at the job site and easier installation and removal. The preferred embodiment can be formed by metal casting thereby eliminating the use of any elastomeric material. This allows the locking pin to be used around caustic or hot environments where prior art locking pins can fail.

The locking pin of the present invention has a generally elongated shape with a proximal end and a distal end. The proximal end serves as an impact surface while the distal end is dimensioned to guide the locking pin during insertion. A first positive stop means can extend outward from the proximal end of the pin. This first positive stop means limits the travel of the pin during insertion. An integral spring is formed by a planar extension angled from the pin and extending upward from the distal end. The integral spring allows for compression during insertion, but resumes its normal position after insertion. A second positive stop means extends from the integral spring. This second stop means prevents removal of the pin from a direction opposite to the direction of insertion. Therefore, to remove the locking pin after its insertion, a sufficient force must be applied to the pin's proximal end to break off the first stop means. This allows the pin to then be driven through the interengaged tooth and adapter.

In an alternative embodiment, the locking pin also incorporates vibration dampening means. This dampening means may be either an elastomeric element or a second integral spring. In another embodiment, the pin is provided with a circular cross-section.

In another embodiment, the locking pin is provided with an integral spring on one side and a guide means. The integral spring extends from the distal end of the wedge member on a lateral side of the locking pin. A guide means also extends from the wedge member near its distal end. The guide means helps turn the pin into a vertical position while the pin is driven into the tooth and adapter assembly. In another embodiment, the locking pin comprises stop means which are radially extendable by spring means.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIGS. 12A and 12B illustrate a one-piece locking pin with circular cross-section and a secant integral spring groove;

FIGS. 13A and 13B illustrate a one-piece locking pin with a circular cross-section and a U-shaped integral spring groove.

DETAILED DESCRIPTION OF THE INVENTION

Figure 1:
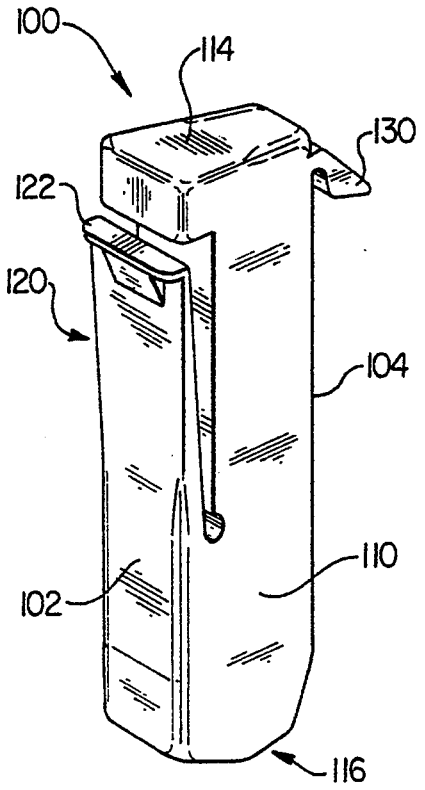
FIG. 1 is a perspective of the one-piece locking pin.

The present invention relates to an improved one-piece locking pin apparatus that is used to captively retain a replaceable excavating tooth point on the nose portion of an adapter which, in turn, is secured to the forward lip of an excavating bucket or the like. Referring to FIG. 1, a locking pin 100 embodying the present invention is shown in perspective. Pin 100 is comprised of a wedge member 110 with a proximal end 114 and a distal end 116. An integral spring 120 is formed on a first side 102 of wedge member 110 while a first positive stop means 130 extends from an opposite side 104 of wedge member 110. Pin 100 can be made of 4140 steel or similar metal such that integral spring 120 cannot be over stressed past its yield point.

Figure 2:
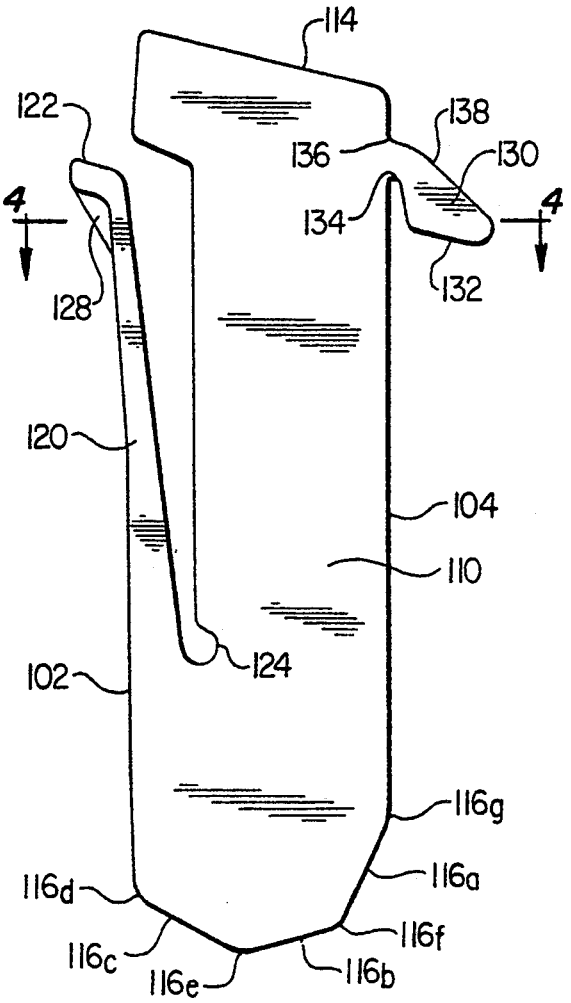
FIG. 2 is a side view of the one-piece locking pin.

Referring to FIGS. 1 and 2 simultaneously, locking pin 1130 has a generally rectangular shape. Proximal end 114 is typically flat while distal end 116 comprises several angled surfaces 116*a*, 116*b*, and 116*c*. As will be discussed in greater detail, end 114 acts as an impact surface while end surfaces 116*a*, 116*b*, and 116*c* act to guide locking pin 100 into position between an adapter and a replaceable tooth. A first distal angle exists between the first surface 102 and the first distal surface 116*c*, a second distal angle exists between the first and third distal surfaces 116*c*, 116*b*, a third distal angle exists between the second and third distal surfaces 116*b*, 116*a*, and a fourth distal angle exists between the second surface 104 and the second distal surface 116*a*. Each of said first, second, third, and fourth distal angles are being greater than or equal to 90 degrees. The first positive stop means 130 may have a stop surface 132 and a slide surface 138. The distance between connection points 134 and 136 is small, thereby making the first positive stop means 130 frangible.

Integral spring 120 extends outward from side 102 of wedge member 110. The integral spring 120 can be connected to the wedge member 110 generally near its distal end 116. The integral spring 120 is typically a resilient, planar member with a second positive stop means 122 at its proximal end. Integral spring 120 may flex inward toward wedge member 110 during its insertion. Due to its resilient nature, the integral spring 120 will resume its normal position upon reaching a locking position. Stress relief surface 124 deters crack formation and propagation between the spring 120 and the wedge member 110. A support 128 formed on spring 120 deters the deformation of second positive stop means 122.

Figure 3:
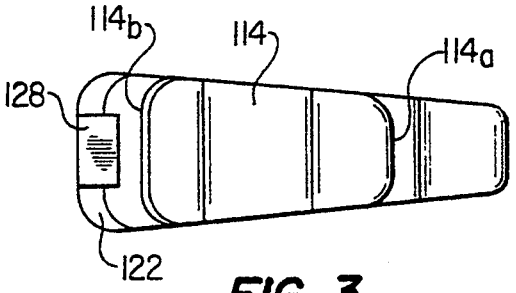
FIG. 3 is a top view of the proximal end of the one-piece locking pin.
Figure 4:
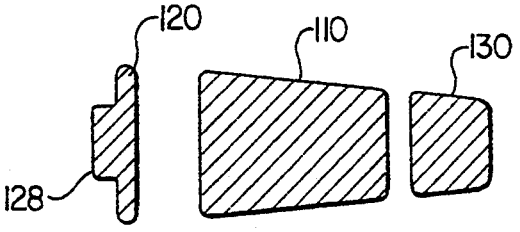
FIG. 4 is a sectional view across section line 4—4 in FIG. 2.

FIGS. 3 and 4 illustrate the trapezoidal cross-section of this embodiment of the locking pin 100. Proximal end 114 is best shown in FIG. 3. Side 114*a* of proximal end 114 is narrower than side 114*b*. This "key" effect prevents the improper insertion of the locking pin 100. FIG. 4 illustrates a sectional view across section line 4—4 in FIG. 2. The spacing between integral spring 120, wedge member 110 and first positive stop means 130 is clearly shown.

FIGS. 5 through 8 illustrate a method of inserting the locking pin 100 into a forward end portion of an excavating tooth and adapter assembly 10 which includes an adapter portion 12, and a replaceable tooth point 14 which is removably secured to the adapter. The adapter has a rearwardly disposed base portion 18 which may be suitably secured to the lower forward lip of an excavating bucket or the like (not illustrated) to support the point of tooth 14 in a forwardly projecting orientation relative to the bucket lip. Together with other similar tooth and adapter assemblies, the assembly 10 defines the digging tooth portion of the overall excavating apparatus.

The tooth 14 is provided with vertically tapered upper and lower side wall portions 20 and 22 which converge at the forward end to a point (not shown) to define a cutting edge. Extending forwardly through the rear end 26 of tooth 14 is a vertically tapered pocket opening 28 that receives a complementarily tapered nose portion 30 which projects forwardly from the adapter base 18 and defines therewith a forwardly facing peripheral shoulder portion 32 that faces and is spaced slightly rearwardly from the rear end 26 of the tooth 14.

Figure 6:
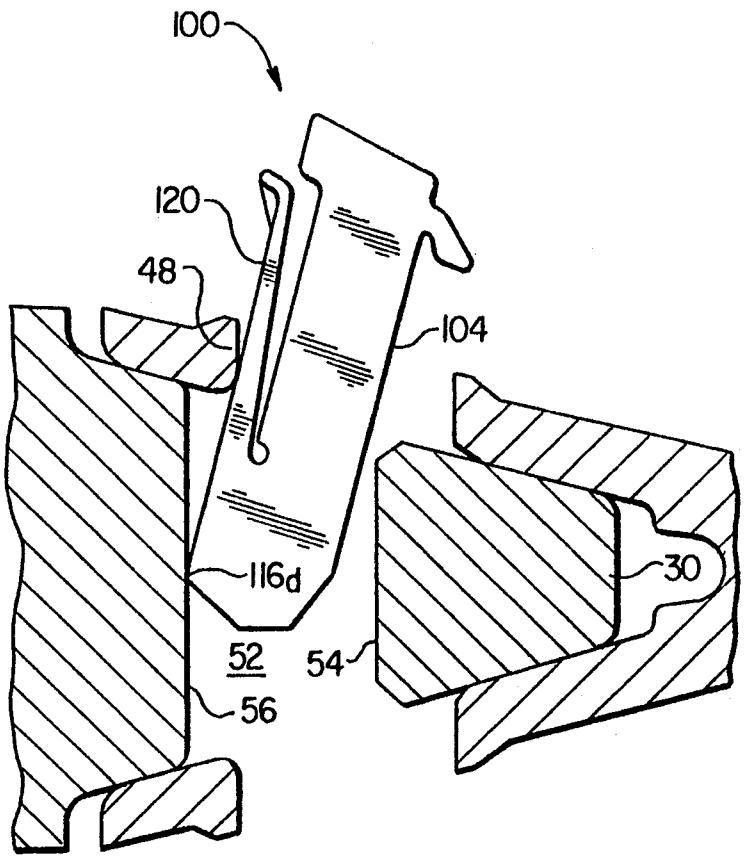
FIGS. 5–8 illustrate the steps of inserting the one-piece locking pin between the adapter portion and the replaceable tooth.
Figure 5:
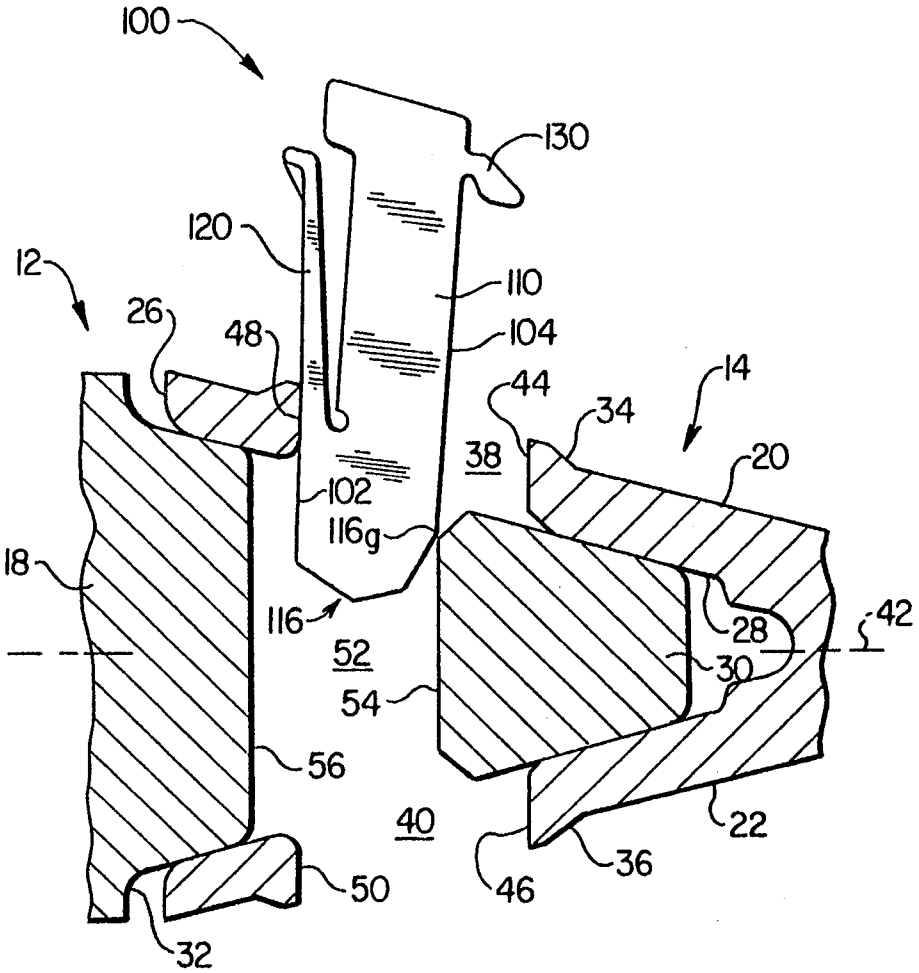

The tooth 14 is respectively provided along its upper and lower side walls 20 and 22 with raised reinforcing portions 34 and 36 through which aligned, generally rectangular cross-sectioned openings 38 and 40 are respectively formed. Openings 38 and 40 are elongated in a direction parallel to the longitudinal axis 42 of the assembly 10 and have forward end surfaces 44 and 46 which are generally perpendicular to axis 42, and forwardly and outwardly sloped rear surfaces 48 and 50. Aligned with the tooth point openings is a generally rectangularly cross-sectioned opening 52 extending vertically through the adapter nose 30. Opening 52 has an essentially flat rear end wall 54, and a forward end wall 56. The present locking pin 100 is received in the aligned tooth and adapter nose openings 38, 40 and 52 and functions in a manner subsequently described to captively retain the tooth 14 on the adapter nose 30 and prevent its separation therefrom. FIG. 5 shows the initial insertion of distal end 116 of locking pin 100 through tooth opening 38 and into adapter opening 52. Integral spring 120 contacts outwardly sloped rear surface 48 of tooth 14. Point 116*a* of the distal end of locking pin 100 contacts surface 54 of tapered nose portion 30. Upon further insertion into adapter opening 52, the locking pin 100 tilts, thereby producing contact between distal point 116*d* to rearward wall 56, as shown in FIG. 6. Wedge member side 104 contacts surface 54 of tapered nose portion 30. Outwardly sloped rear surface 48 moves upward along integral spring 120.

Figure 7:
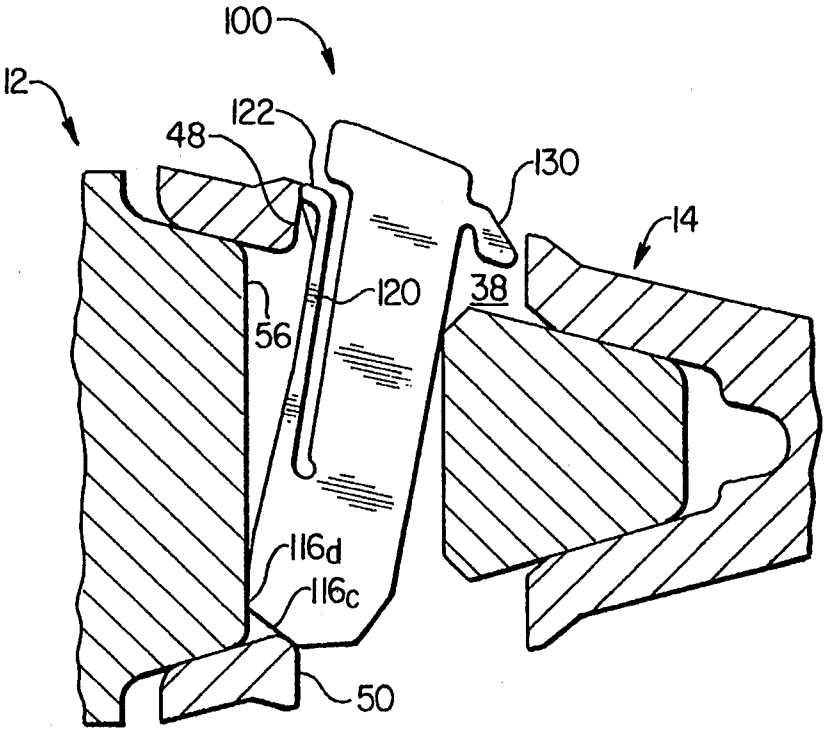

FIG. 7 shows the locking pin 100 in almost a completely inserted position. Outwardly sloped rear surface 48 contacts second positive stop means 122 as integral spring 120 is forced to a compressed position. First positive stop means 130 enters opening 38 in tooth 14. Also, distal point 116*d* moves lower on rearward wall 56 while distal surface 116*c* contacts sloped rear surface 50. Further downward force exerted on locking pin 100 causes the pin to straighten due to the taper of distal surface 116*c*. This straightening causes second positive stop means 122 to further slide downward on rear surface 48.

Figure 8:
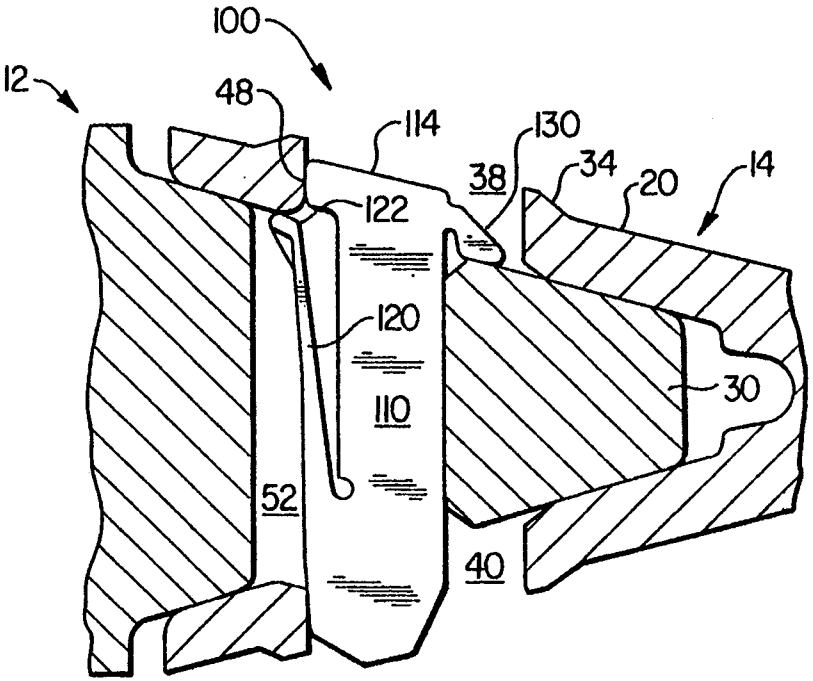

After a predetermined distance of slide the second positive stop means 122 disengages rear surface 48 and integral spring 120 returns to its non-compressed position as shown in FIG. 8. Simultaneously, first positive stop means 30 contacts nose portion 30. Furthermore, the distal portion of surface 102 engages rearward surface 50. In its final insertion position, locking pin 100 is incapable of being forced further into openings 38, 40 or 52 without extreme deformation of either first positive stop means 130 or adapter nose 30. Nor can the locking pin 100 be withdrawn from openings 38, 40 or 52 without extreme deformation of integral spring 120 or second positive stop means 122. Therefore, the pin 100 is locked into position and prevents the separation of adapter 12 from tooth 14. To remove locking pin 100 from this position, a predetermined force must be applied to surface 114 to break first positive stop means 130 from the wedge member 110, thereby allowing the pin 100 to be completely driven through opening 40. Note that proximal surface 114 is positioned below the height of either upper side wall portion 20 or raised reinforcing portion 34. Thus, the proximal surface 114 is protected from unwanted impact which could accidently break off first positive stop means 130. Also, during insertion, the inserter can easily determine when to stop applying force to the proximal surface 114 based upon a visual inspection of its position.

Figure 9A:
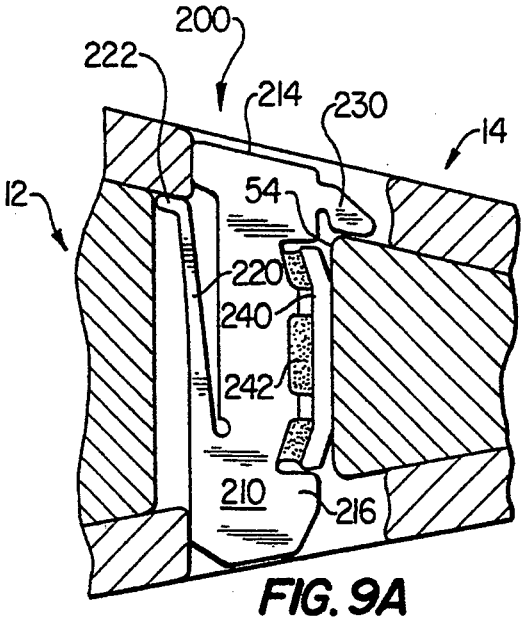
FIGS. 9A and 9B disclose an alternate locking pin embodiment with vibration dampening elements.
Figure 9B:
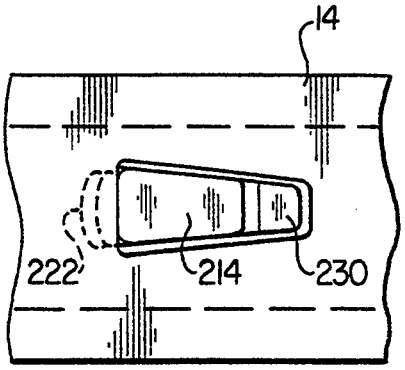

FIGS. 9A and 9B illustrate locking pin 200, an alternative embodiment of the invention. While this pin 200 is not a single-piece unit, it shares many of the same features of pin 100. For example, pin 200 has a proximal end 214 and a distal end 216 dimensioned to aid in the insertion of the pin between adapter 12 and tooth 14. Locking pin 200 further has a first and second positive stop means 230, 222 similar in shape and function to those described for locking pin 100. However, pin 200 has additional vibration dampening features including bearing element 240. Bearing element 240 can be attached to wedge member 210 by at least one resilient member 242. These resilient members 242 can be made of materials including neoprene or other vibration dampening materials. Bearing element 240, upon insertion, firmly contacts rear end wall 54. Thus, vibration from the normal use of the excavating equipment may be transmitted from the tooth to the locking pin 200, whereupon it is largely diminished prior to its transmission to adapter 12.

Figure 10A:
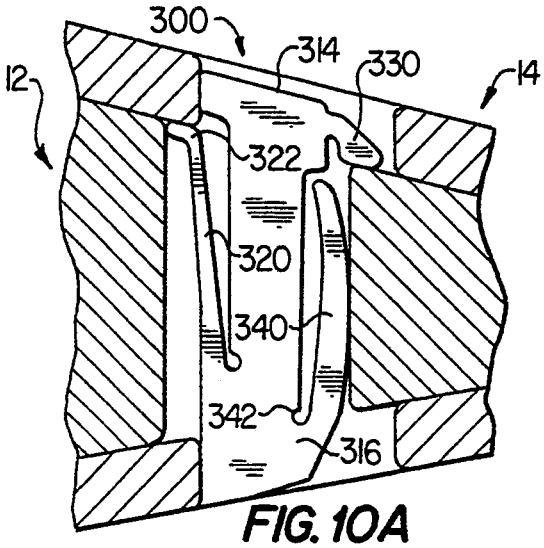
FIGS. 10A and 10B disclose an alternate one-piece locking pin embodiment with vibration dampening elements.
Figure 10B:
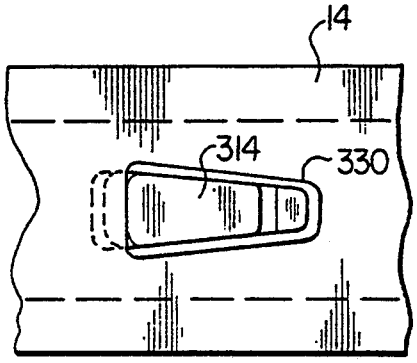

FIGS. 10A and 10B illustrate yet another alternate embodiment. Locking pin 300, again has similar features to pin 100, including a proximal end 314 and distal end 316 dimensioned to aid in the insertion of the pin between adapter 12 and tooth 14. Locking pin 300 controls vibration with a second integral spring 340 which firmly contacts rear end wall 54 after insertion. Second integral spring 340 extends upward from distal end 316 in a generally curved fashion. Stress relief surface 342 is provided to deter crack formation and propagation. Again, as vibration is transmitted from tooth 14 to pin 300, second integral spring 340 minimizes transmission of said vibration from pin 300 to adapter 12. Locking pin 300 is removed in similar fashion to each locking pin described. Excess force is applied to proximal end 314, breaking first positive stop means 330 from the pin. The pin 300 may then be driven through the assembly, thereby allowing removal and replacement of tooth 14.

Figure 11A:
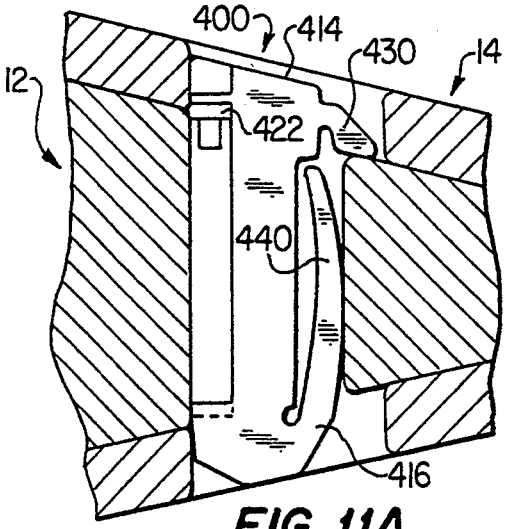
FIGS. 11A and 11B disclose an alternate one-piece locking pin embodiment with vibration dampening elements and perpendicularly disposed first and second stop means.
Figure 11B:
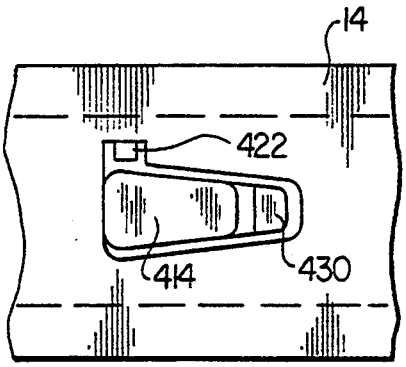

FIGS. 11A and 11B disclose yet another variation of the present invention with locking pin 400. Locking pin 400 also has a second integral spring means 440 extending from the distal end 416. However, a second positive stop means 422 extends perpendicularly from wedge member 410. This relationship is better shown in FIG. 11B. This configuration allows for a slightly wider locking pin.

FIGS. 12A and 12B and FIGS. 13A and 13B disclose horizontal locking pin embodiments 500 and 600. Both embodiments feature a generally circular cross-section with an integral spring 520, 620 extending upward from a midsection of wedge members 510, 610. Integral spring 520, shown in FIGS. 12A and 12B, comprises the entire arc formed by secant groove 524 which divides the integral spring 520 from the wedge member 510. FIGS. 13A and 13B illustrate an integral spring 620 separated from the wedge member 610 by a U-shaped groove 624. Both embodiments utilize a first positive stop means 530, 630 and a second positive stop means 522, 622 as in previously described embodiments. Both first positive stop means are located in opening 38. Thus, circular locking pins 500, 600 cannot rotate sufficiently to allow integral spring means 520, 620 to escape through opening 38. Note also that first stop means 530, 630 do not contact adapter 12 when inserted. Instead, contact occurs only when the locking pins 500, 600 are forced further into the assembly than normal. In order to drive locking pins 500, 600 out of position, a tool adapted to insert into opening 38 must contact the pins. Force is then applied to cause first stop means 530, 630 to contact adapter 12 and break off. The pin may then be driven out of the assembly.

Figure 14:
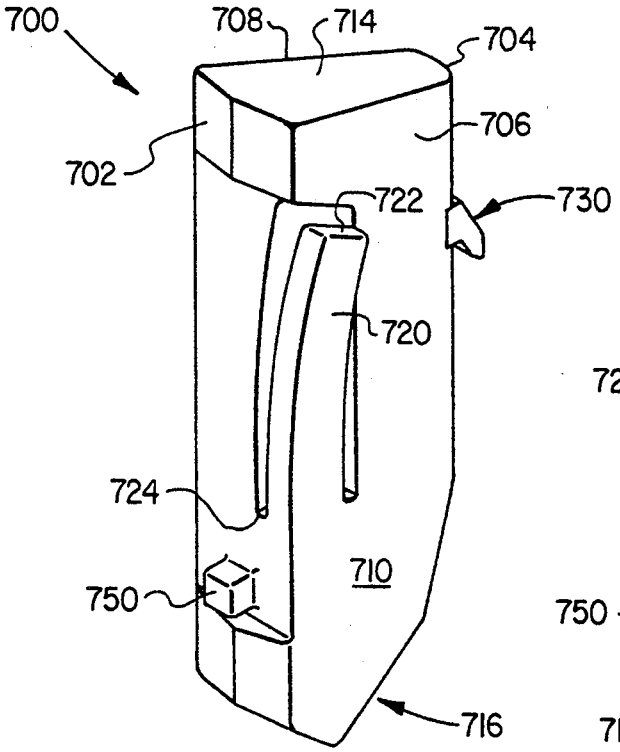
FIG. 14 is a perspective view of a first embodiment of a side spring locking pin having a distal guide means.
Figure 15:
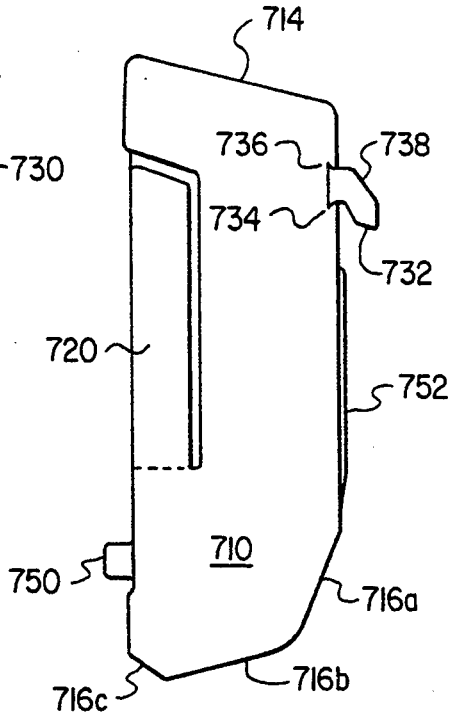
FIG. 15 is a side view of the first embodiment of the side spring locking pin having a distal guide means.

Referring to FIGS. 14 and 15 simultaneously, locking pin 700 has a generally rectangular shape. Proximal end 714 is typically fiat while distal end 716 comprises several angled surfaces 716*a*, 716*b*, 716*c*. As with earlier described embodiments, end 114 acts as an impact surface while end surfaces 714, while end surfaces 716*a*, 716*b*, and 716*e* act to guide locking pin 700 into position between an adapter and a replaceable tooth. A first distal angle exists between the first surface 702 and the first distal surface 716*c*, a second distal angle exists between the first and third distal surfaces 716*c*, 716*b*, a third distal angle exists between the second and third distal surfaces 716*b*, 716*a*, and a fourth distal angle exists between the second surface 704 and the second distal surface 716*a*. Each of said first, second, third, and fourth distal angles are greater than or equal to 90 degrees. First and second surfaces 702, 704 are generally parallel while the third and fourth surfaces 706, 708 are tapered toward each other to produce a trapezoidal cross-section. This "key" effect prevents the improper insertion of the locking pin 700.

A first stop means 730 extends from the second surface 704 near the proximal end 714. The first stop means 730 can have a stop surface 732 and a slide surface 738. The first stop means prevents unwanted downward motion of the locking pin after its insertion. The distance between connection points 734 and 736 is small, thereby making the first stop means 730 frangible. Integral spring 720 extends outward from third side 706 of wedge member 710. The integral spring 720 can be connected to the wedge member 710 generally near its distal end 716. The integral spring 720 is typically a resilient, planar member with an unconnected proximal end which acts as a second stop means 722. Integral spring 720 may flex inward toward wedge member 710 during its insertion. Due to its resilient nature, the integral spring 720 will resume its normal position upon reaching a locking position. Stress relief surface 724 deters crack formation and propagation between the spring 720 and the wedge member 710. A guide means 750 extends from the first surface 702 near the distal end 716. As will be discussed later, the guide means 750 helps to guide the locking pin 700 into position during insertion. Additionally, the guide means 750 acts as a third stop means to prevent downward motion of the locking pin. Both the first stop means 730 and the guide means 750 can be broken from the wedge member 710 by a powerful blow to the proximal surface 714. Once these members are broken away, the locking pin 700 can be driven through the interengaged tooth and adapter assembly. A deformable ridge 752 extends from second surface 704.

FIGS. 16, 17, 18, and 23 illustrate a method of inserting the locking pin 700 into a forward end portion of an excavating tooth and adapter assembly 10 which includes an adapter portion 12, and a replaceable tooth point 14 which is removably secured to the adapter. Refer to the discussion of FIGS. 5, 6, 7, and 8 for a more detailed discussion of the adapter and tooth point. The present locking pin 700 is received in the aligned tooth and adapter nose openings 38, 40 and 52 and functions in a manner subsequently described to captively retain the tooth 14 on the adapter nose 30 and prevent its separation therefrom. The width of tooth 700 should precisely match the size of the aligned tooth and adapter openings. However, if the tooth is slightly smaller than the aligned openings, a tolerance can exist between the adapter nose and the tooth after the locking pin is inserted. This tolerance leads to an unwanted looseness or "jiggle" to the tooth. The deformable ridge 752 compensates for any tolerance. In other words, the ridge 752 extends the width greater than the opening in the aligned tooth and adapter. When the locking pin is driven into the aligned openings, the ridge 752 can deform, thereby eliminating any tolerance.

Figure 16:
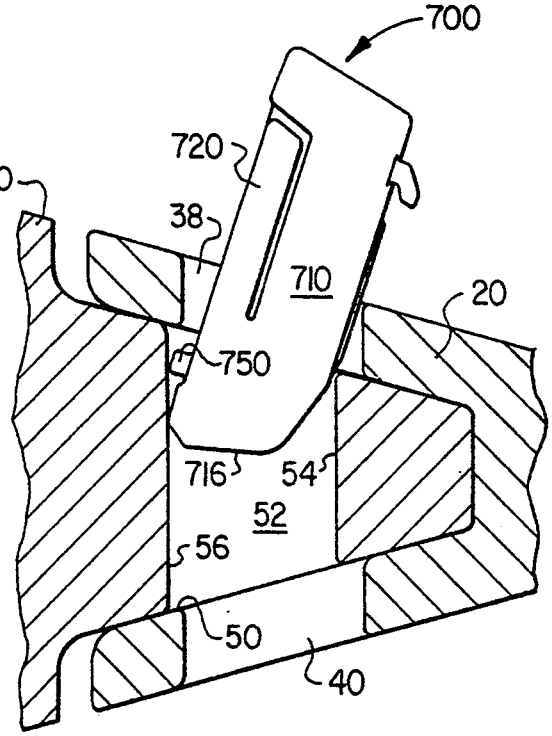
FIGS. 16, 17, and 18 illustrate a method of inserting a side spring locking pin.
Figure 17:
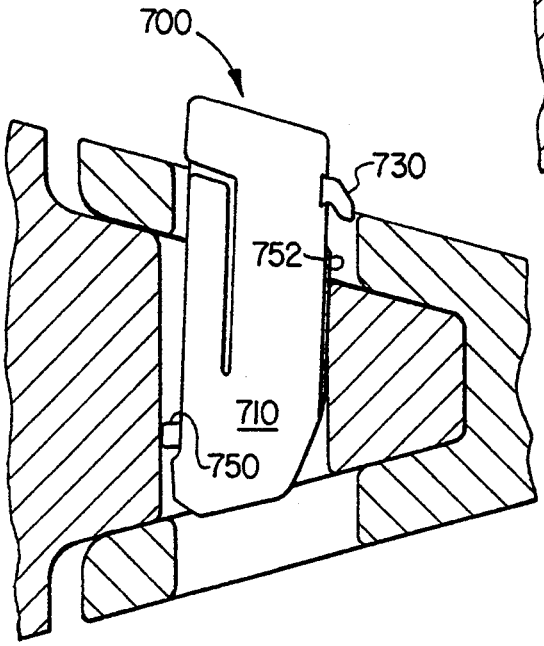
Figure 18:
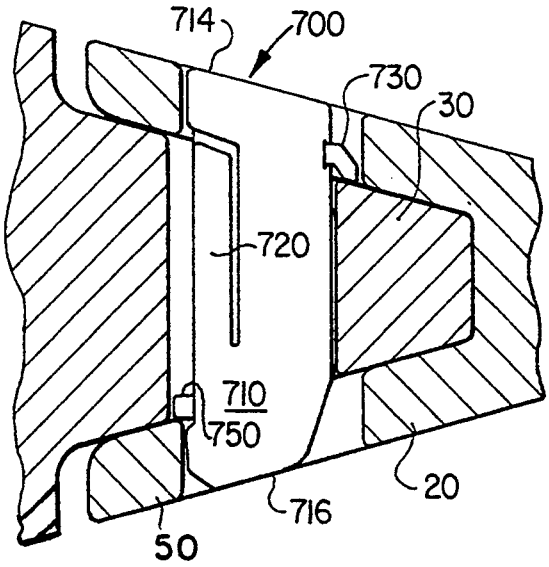
Figure 23:
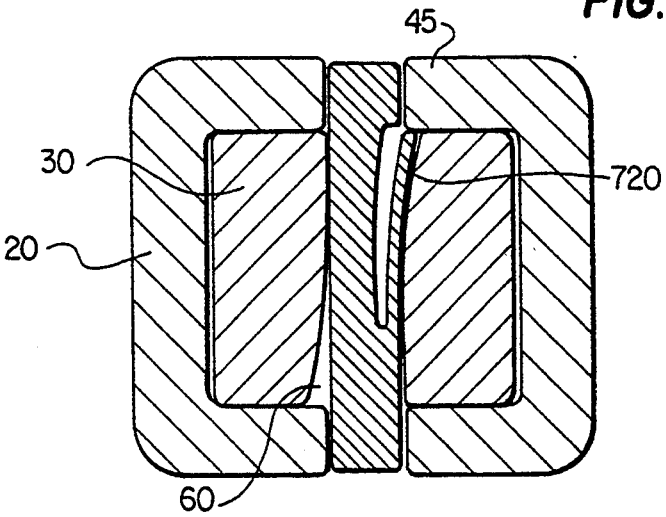
FIG. 23 is a sectional view across the adapter and tooth assembly showing the side spring extending under the tooth to prevent withdrawal of the locking pin.

FIG. 16 shows the initial insertion of distal end 716 of locking pin 700 through tooth opening 38 and into adapter opening 52. Integral spring 720 contacts lateral wall 45 (shown in FIG. 23) and compresses toward the wedge member 710. Guide means 750 contacts surface 56 while the deformable ridge 752 contacts surface 54 of tapered nose portion 30. Upon further insertion into adapter opening 52, the locking pin 700 tilts back toward a vertical position. FIG. 17 shows the locking pin 700 in almost a completely inserted position. The guide means 750 forces the pin 700 to a vertical position. The guide means 750 allows for the use of a shorter locking pin by diminishing the importance of a long distal surface 116*c* as discussed in FIG. 7. The integral spring 720 is forced to a compressed position. First stop means 730 enters opening 38 in tooth 14. In FIG. 18 the locking pin 700 is shown fully engaged between the tooth and adapter assembly. After a predetermined distance of slide the guide means 750 contacts the rear surface 50 of the tooth. Simultaneously, first stop means 730 contacts nose portion 30. As shown in FIG. 23, the adapter is configured with two indentations 60. Either indentation 60 can receive the integral spring 720 when it disengages lateral surface 45 and returns to its non-compressed position. Due to the configuaration of the adapter, the locking pin can be driven into the interengaged tooth and adapter from either direction.

In its final insertion position, locking pin 700 is incapable of being forced further into openings 38, 40 or 52 without extreme deformation of either first stop means 730, guide means 750 or adapter nose 30. Nor can the locking pin 700 be withdrawn from openings 38, 40 or 52 without extreme deformation of integral spring 720. Therefore, the pin 700 is locked into position and prevents the separation of adapter 12 from tooth 14. To remove locking pin 700 from this position, a predetermined force must be applied to surface 714 to break first stop means 730 and guide means 750 from the wedge member 710, thereby allowing the pin 700 to be completely driven through opening 40. Note that distal surface 716 is positioned flush with the outer surface of the tooth 20 to protect it from any impact.

Figure 19:
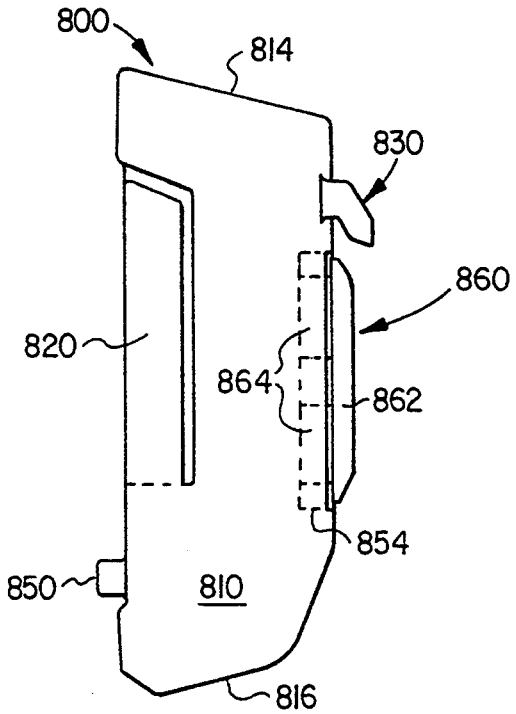
FIG. 19 is a side view of a second embodiment of the side spring locking pin having a rigid plate and elastomer compression element.

FIG. 19 illustrates a side spring locking pin 800. Locking pin 800 is identical to locking pin 700 except for compression element 860. The compression element 860 absorbs any tolerance between the tooth, adapter, and locking pin. The compression element 860 fits within a compression element slot 854 in the second surface 704. The slot 854 has a rear surface. The compression element 860 comprises a rigid plate 862 attached to an elastomer element 864. The elastomer element 864 can be any suitable material, such as neoprene, which is elastically compressible. The rigid plate 864 can be made of the same material as the locking pin. When inserted, the rigid plate 862 is forced into the compression element slot 854, thus compressing the elastomeric element 864 against the rear surface of the slot.

Figure 20:
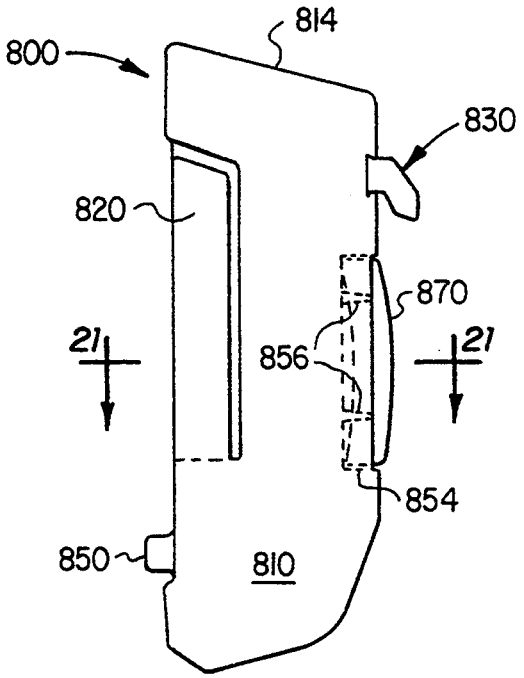
FIG. 20 is a side view of a third embodiment of the side spring locking pin having flexible curved compression element.
Figure 21:
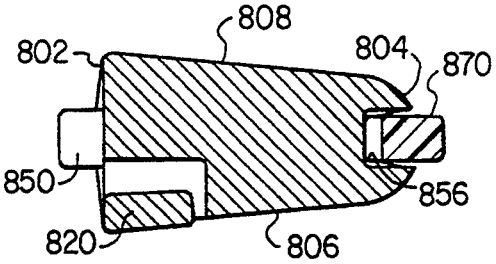
FIG. 21 is a top view of the third embodiment of the side spring locking pin showing tapered grooves in a compression element slot which engage the flexible curved compression element.
Figure 22:
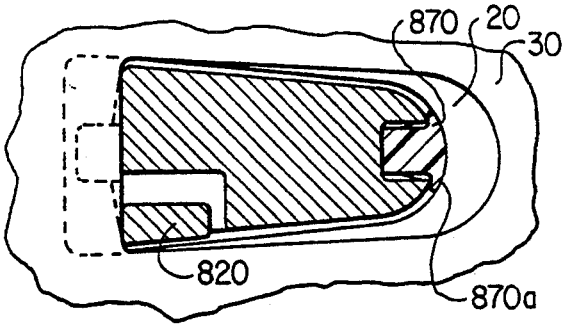
FIG. 22 illustrates the flexible compression element in a compressed and deformed state.

Referring to FIGS. 20, 21, and 22 simultaneously, another version of locking pin 800 incorporates a semi-rigid compression element 870 in compression element slot 854. The semi-rigid compression element 870 is curved and made of a stiff material such as glass reinforced nylon. The compression element 870 fits snugly within the slot 854 to prevent its loss prior to insertion. To help hold the element 870 in place, a pair of opposed ridge sets 856 extend into slot 854. In preferred embodiment, two pair of opposed ridges extend into the slot 854. Each ridge tapers down from the base of the slot. In a preferred embodiment the curved portion of the compression element 870 extends out from the slot 854. When the compression element 870 is inserted into the slot 854, the compression element is slightly wedged by the ridges 856. The compression element 870 will flaten once inserted. Furthermore, a portion of the flattened compression element still extends beyond slot 854 and can deform, as shown in FIG. 22, due to the forces encountered during insertion or use. The deformed portion 870*a* absorbs any tolerance between the tooth, adapter, and locking pin.

Figure 24:
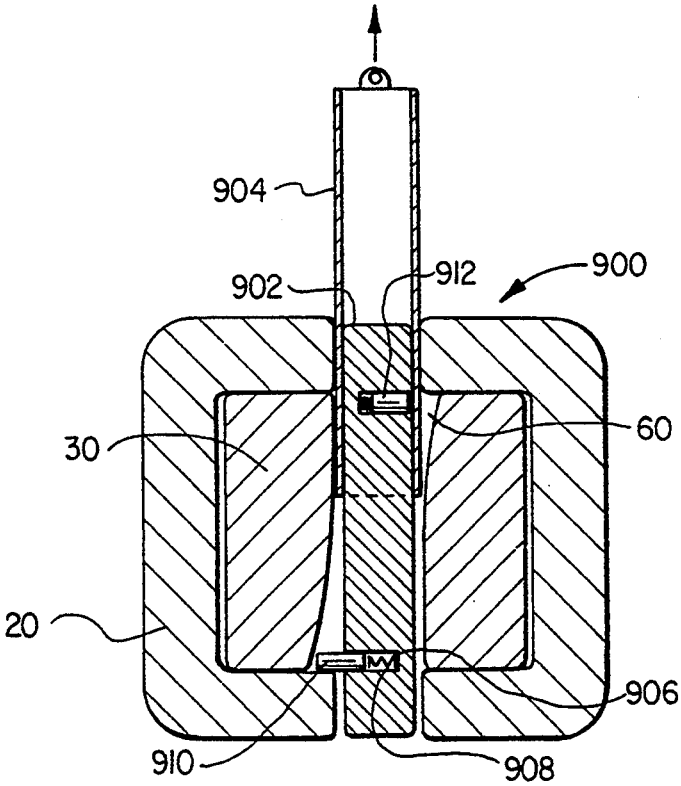
FIG. 24 is a sectional view of a locking pin having radially retractable stop means.

FIG. 24 provides a sectional view of another locking pin embodiment having radially retractable stop means. Locking pin 900 does not utilize an integral spring, but instead has a first and second stop means 910, 912. Both stop means are received within radial holes 906. A spring means 908 is located within each radial hole. Both stop means have either a retracted or extended position. A sleeve 904 surrounds the locking pin body 902, keeping the stop means in a retracted position. The pin and sleeve are inserted into the transversely aligned holes in the interengaged tooth and adapter. The sleeve 904 is then removed by pulling it axially away from the pin 900. As the sleeve 904 is removed, first stop means extends radially into indentation 60. Likewise, when the sleeve 904 is completely removed, the second stop means 912 will also extend radially. The first and second stop means 910, 912 will prevent the upward or downward egress of the locking pin 900. When the tooth 20 is to be removed from the adapter 30, a force is applied to pin surface 902 to break the stop means, thereby allowing the pin to pass through the aligned openings.

Figure 25:
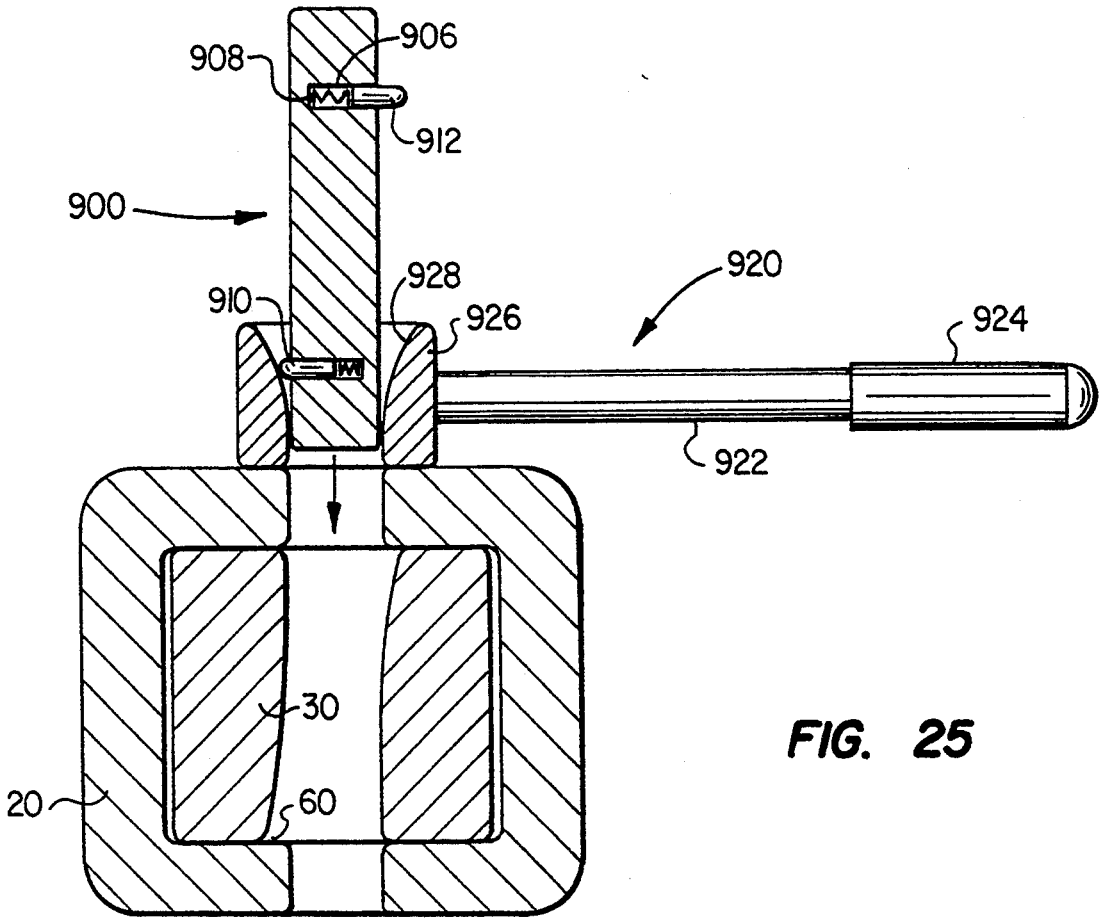
FIGS. 25 and 26 are sectional views of the locking pin shown in FIG. 24 being inserted into the interengaged tooth and adapter assembly.
Figure 26:
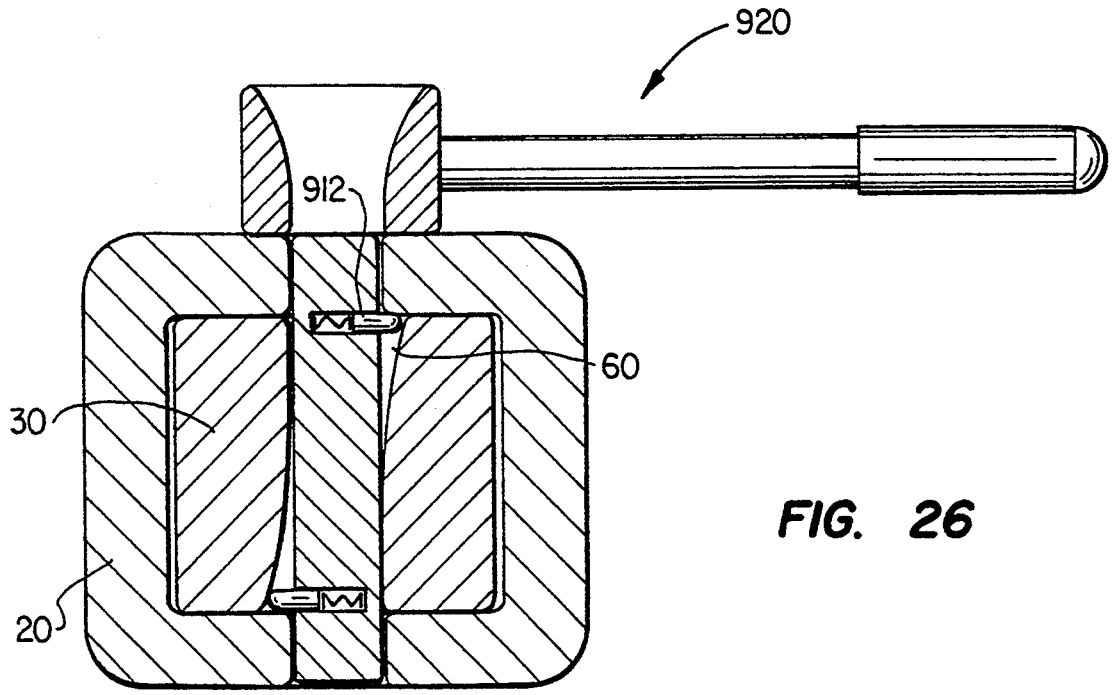

FIGS. 25 and 26 illustrate the locking pin 900 being inserted into the interengaged tooth and adapter assembly with insertion tool 920. The tool 920 comprises a handle 922 with a grip 924 and a head 926. The head 926 provides a cam surface 928. The pin 900 is driven through the cam surface 928. The stop means 910 is compressed against the cam surface, allowing the wedge member to enter the interengaged tooth and adapter assembly. Likewise, the stop means 912 is also compressed against compression means 908 when it enagages the cam surface. Once inserted, the stop means 910, 912 extend into indentations 60.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit of the scope of the invention.

I claim:

1. A locking pin for captively retaining a tooth to an adapter of an excavating tooth and adapter assembly, said locking pin comprising:

(a) a wedge member with a distal end, a proximal end, a first surface, a second surface, and a third surface;

(b) a first stop means extending from the second surface;

(c) an integral spring extending from the third surface, wherein said integral spring means comprises a planar member extending upward from the distal end of the wedge member; and (d) a frangible guide means extending outwardly from the first surface near the distal end of said wedge member.

2. The locking pin of claim 1 wherein said wedge member has a trapezoidal cross-section.

3. The locking pin of claim 1 wherein the first and second surfaces are opposed.

4. The locking pin of claim 1 wherein both the first stop means and said guide means are frangible from the wedge member.

5. The locking pin of claim 1 further comprises:

(e) compression element engaged with and extending from said second surface.

6. The locking means of claim 5 wherein said compression element comprises an integral, deformable ridge on said second surface.

7. The locking pin of claim 5 wherein said compression element comprises a semi-rigid curved object positioned in a compression element slot in the second surface.

8. The locking pin of claim 5 wherein the compression element comprises a rigid plate in a compression element slot in the second surface, said slot having a rear surface, with an elastomeric element between said rear surface and said rigid plate.

9. The locking pin of claim 1 wherein said first stop means extends from the second surface adjacent to the proximal end of said wedge member.

10. The locking pin of claim 1 wherein said guide means is configured to force said locking pin to an orientation generally perpendicular to the tooth and adapter assembly.

11. A locking pin for captively retaining a tooth to an adapter of an excavating tooth and adapter assembly, said locking pin comprising:

(a) a wedge member with a distal end, a proximal end, a first, second, third and fourth surface, wherein said wedge member has a trapezoidal cross-section;

(b) a frangible first stop means extending from the second surface;

(c) an integral spring extending from the third surface, wherein said integral spring means comprises a planar member extending upward from the distal end of the wedge member;

(d) a frangible guide means extending outwardly from the first surface of said wedge member; and (e) a compression element engaged with and extending from said second surface.

12. The locking means of claim 11 wherein said compression element comprises an integral, deformable ridge on said second surface.

13. The locking pin of claim 11 wherein said compression element comprises a semi-rigid curved object positioned in a compression element slot in the second surface.

14. The locking pin of claim 11 wherein the compression element comprises a rigid plate in a compression element slot in the second surface, said slot having a rear surface, with an elastomeric element between said rear surface and said rigid plate.

15. The locking pin of claim 11 wherein said first stop means extends from the second surface adjacent to the proximal end of said wedge member.

16. The locking pin of claim 11 wherein said guide means extends from the first surface adjacent to the distal end of said wedge member.

* * * * *